US008273004B2

(12) United States Patent
Oota et al.

(10) Patent No.: US 8,273,004 B2
(45) Date of Patent: Sep. 25, 2012

(54) PAPER FOLDING MECHANISM AND PAPER FOLDING APPARATUS

(75) Inventors: Ryuichi Oota, Kinokawa (JP); Hideki Oiwa, Kinokawa (JP); Masasuke Funase, Kinokawa (JP); Takaaki Maeda, Kinokawa (JP)

(73) Assignee: Duplo Seiko Corporation, Kinokawa-Shi, Wakayama (JP)

( * ) Notice: Subject to any disclaimer, the term of this patent is extended or adjusted under 35 U.S.C. 154(b) by 426 days.

(21) Appl. No.: 12/595,840

(22) PCT Filed: Feb. 26, 2009

(86) PCT No.: PCT/JP2009/053516

§ 371 (c)(1),
(2), (4) Date: Oct. 14, 2009

(87) PCT Pub. No.: WO2009/142039

PCT Pub. Date: Nov. 26, 2009

(65) Prior Publication Data

US 2010/0222195 A1 Sep. 2, 2010

(30) Foreign Application Priority Data

May 22, 2008 (JP) ..... 2008-134139

(51) Int. Cl.
*B31F 1/10* (2006.01)

(52) U.S. Cl. ..... 493/444; 493/445; 493/442; 493/449

(58) Field of Classification Search ..... 493/444, 493/442–443, 445, 449, 416, 405
See application file for complete search history.

(56) References Cited

U.S. PATENT DOCUMENTS 3,616,069 A * 10/1971 Schwalbach ..... 156/444
3,841,621 A * 10/1974 Brown ..... 493/8
(Continued)

FOREIGN PATENT DOCUMENTS

JP 46-9442 4/1971
(Continued)

OTHER PUBLICATIONS

International Search Report of Application PCT/JP2009/053516 dated Apr. 14, 2009 (with English language translation of category of cited documents).

(Continued)

*Primary Examiner* — Christopher Harmon
(74) *Attorney, Agent, or Firm* — Buchanan Ingersoll & Rooney PC

(57) ABSTRACT

A paper folding mechanism includes: first and second folding rollers (51, 52); first and second conveyance rollers (61, 62); a protrusion member (71); and a control part. Both the rollers (51, 52) are provided so that a paper is sandwiched therebetween with its fold line located in front, and is allowed to pass therethrough in a first direction. The first folding roller (51) and the first conveyance roller (61) are provided so that the paper is sandwiched therebetween and conveyed in a second direction orthogonal to the first direction. The second folding roller (52) and the second conveyance roller (62) are provided so that the paper is sandwiched therebetween and conveyed in any one of the second direction and the direction opposite thereto. The protrusion member (71) is provided so that the fold line of the paper conveyed by both the rollers (61, 62) is protruded in the first direction and fed between both the rollers (51, 52).

3 Claims, 17 Drawing Sheets

U.S. PATENT DOCUMENTS

| | | | | |
|---|---|---|---|---|
| 4,643,705 | A * | 2/1987 | Bober | 493/444 |
| 5,738,620 | A * | 4/1998 | Ebner et al. | 493/445 |
| 6,592,506 | B1 * | 7/2003 | Lyga | 493/424 |
| 6,730,010 | B2 * | 5/2004 | Yamakawa et al. | 493/267 |
| 8,002,256 | B2 * | 8/2011 | Sasahara | 270/45 |

FOREIGN PATENT DOCUMENTS

| | | | |
|---|---|---|---|
| JP | 58-180842 | U | 12/1983 |
| JP | 62-027276 | A | 2/1987 |
| JP | 63-065672 | U | 4/1988 |
| JP | 3-073757 | A | 3/1991 |
| JP | 5-201610 | A | 8/1993 |
| JP | 2001-341937 | A | 12/2001 |
| JP | 2005-041658 | A | 2/2005 |
| JP | 2008-037640 | A | 2/2008 |

OTHER PUBLICATIONS

Written Opinion of the International Searching Authority of Application PCT/JP2009/053516 dated Apr. 14, 2009.

* cited by examiner

PAPER FOLDING MECHANISM AND PAPER FOLDING APPARATUS

TECHNICAL FIELD

The present invention relates to a paper folding mechanism for performing a folding process on a paper along its fold line while conveying the paper, and a paper folding apparatus including at least two of the mechanisms.

BACKGROUND ART

As a mechanism for performing a folding process on a paper along its fold line while conveying the paper, mechanisms according to Patent Documents 1 to 4, for example, are known. The mechanisms according to Patent Documents 1 and 2 are of so-called "buckle type", and the mechanisms according to Patent Documents 3 and 4 are of so-called "knife type".

Patent Document 1: Japanese Unexamined Utility Model Application Publication No. 58-180842

Patent Document 2: Japanese Unexamined Patent Application Publication No. 5-201610

Patent Document 3: Japanese Unexamined Utility Model Application Publication No. 63-65672

Patent Document 4: Japanese Unexamined Patent Application Publication No. 2005-41658

DISCLOSURE OF THE INVENTION

Problems to be Solved by the Invention

In the case of performing a folding process on a thick paper by using the "buckle type" mechanisms described in Patent Documents 1 and 2, the following problems occur.

(1) In folding a paper in a buckle, a conveyance force generated by a conveyance roller becomes deficient, and slippage easily occurs between the paper and the conveyance roller, thus damaging the paper.

(2) Even if the paper can be conveyed without slippage, a folded position is deviated.

(3) In the case of performing a folding process so as to provide so-called "gate-folding", i.e., folding in the form of inner double doors, an inner edge of one of folded pieces of the paper will be present oppositely to a conveyance direction, and therefore, it becomes difficult to convey the paper, thus making the folding process difficult.

Further, in the case of performing a folding process on a thick paper by using the "knife type" mechanisms described in Patent Documents 3 and 4, there occurs a problem that a folded position is deviated.

An object of the present invention is to provide a paper folding mechanism and a paper folding apparatus, which are capable of accurately folding a paper along its fold line without damaging the paper.

Solution to the Problems

The present invention provides a paper folding mechanism for performing a folding process on a paper along its fold line while conveying the paper, wherein the paper folding mechanism includes: first and second folding rollers; first and second conveyance rollers; a protrusion member; and a control part, wherein the first and second folding rollers are provided so that the paper is sandwiched therebetween with its fold line located in front, and is allowed to pass therethrough in a first direction, wherein the first folding roller and the first conveyance roller are provided so that the paper is sandwiched therebetween and conveyed in a second direction orthogonal to the first direction, wherein the second folding roller and the second conveyance roller are provided so that the paper is sandwiched therebetween and conveyed in any one of the second direction and the direction opposite thereto, wherein the protrusion member is provided so that the fold line of the paper, which has been conveyed by the first and second conveyance rollers, is protruded in the first direction and fed between the first and second folding rollers, the protrusion member being provided so as to be movable among: a standby position at which the protrusion member does not come into contact with the paper that has been conveyed; a feeding position at which the fold line of the paper that has been conveyed is protruded and fed between the first and second folding rollers; and a guide position at which the paper to be conveyed is guided between the first and second folding rollers, and wherein at the time of a feeding operation, the control part moves the protrusion member to the feeding position and rotates each of the rollers so as to advance the fold line of the paper in the first direction, and at the time of a folding operation, the control part moves the protrusion member to the guide position and rotates each of the rollers so as to advance the fold line of the paper in the first direction.

In the paper folding mechanism of the present invention, the following structure (A) is preferably adopted.

(A) The protrusion member comprises: a pointed end for allowing the fold line of the paper to enter between the first and second folding rollers; and curved surface portions extended obliquely on both sides of the pointed end in the direction opposite to the first direction.

The present invention further provides a paper folding apparatus comprising at least two of the paper folding mechanisms, which are arranged one above the other so that a folding process can be continuously performed on a paper, wherein an upper apparatus part comprising the upper paper folding mechanism is provided so as to be openable and closable with respect to a lower apparatus part comprising the lower paper folding mechanism, wherein the paper folding mechanism of the lower apparatus part is provided so as to be exposed upon opening of the upper apparatus part with respect to the lower apparatus part, wherein the upper apparatus part is constantly urged upward from the lower apparatus part, and wherein the upper apparatus part is closed with respect to the lower apparatus part by hooking the upper apparatus part to a fastener extended from the lower apparatus part.

Effects of the Invention

The paper folding mechanism of the present invention is capable of achieving the following effects.

(1) In a conveyance operation, a paper is sandwiched between the first folding roller and the first conveyance roller, and is then sandwiched between the second folding roller and the second conveyance roller, so that the paper is conveyed thereby; therefore, the paper can be conveyed to the accurate position. Accordingly, the fold line can be accurately set at the position of the protrusion member.

(2) In the feeding operation, the protrusion member is moved to the "feeding position" together with the fold line, and the rollers are rotated so that the fold line advances in the first direction. Therefore, the fold line of the paper can be fed between the first and second folding rollers accurately and smoothly. Accordingly, the paper can be accurately folded along the fold line.

(3) In the folding operation, the rollers are rotated so that the fold line advances in the first direction. Therefore, the occurrence of slippage between the paper and the respective rollers can be prevented, and it is possible to facilitate the passage of the paper between the first and second folding rollers, with the fold line located in front. Accordingly, it is possible to smoothly perform the folding process without damaging the paper.

In the structure (A), the protrusion member is set at the "guide position" in the feeding operation and the folding operation, thereby allowing an inner edge of a folded piece of the paper to be smoothly conveyed along the curved surface portion. Accordingly, the feeding operation and the folding operation can be smoothly performed.

The paper folding apparatus of the present invention is capable of achieving the following effects.

(1) Since the paper folding apparatus includes at least two of the paper folding mechanisms, folding processes can be accurately performed on at least two fold lines.

(2) When a jam has occurred in either of the upper and lower paper folding mechanisms, the jam can be easily cleared because both the mechanisms can be exposed by opening the upper apparatus part with respect to the lower apparatus part.

(3) Although the upper apparatus part is openable and closable with respect to the lower apparatus part, the upper apparatus part is constantly urged upward from the lower apparatus part, and therefore, the upper apparatus part is constantly closed with respect to the lower apparatus part at the height position of the tip of the fastener. Accordingly, the height position of the upper paper folding mechanism with respect to the lower paper folding mechanism can be maintained at a constant value with accuracy at all times. Hence, the folding process can be accurately performed on the fold line in the upper paper folding mechanism.

DESCRIPTION OF THE REFERENCE CHARACTERS

1: paper folding apparatus, 10: lower apparatus part, 12: first paper folding mechanism, 20: upper apparatus part, 22: second paper folding mechanism, 40: fastener, 51: first folding roller, 52: second folding roller, 61: first conveyance roller, 62: second conveyance roller, 71: protrusion member, 711: pointed end, 712, 713: curved surface portion

BEST MODE FOR CARRYING OUT THE INVENTION

Hereinafter, embodiments of a paper folding mechanism and a paper folding apparatus according to the present invention will be described.

[Overall Structure of Apparatus]

Figure 1:
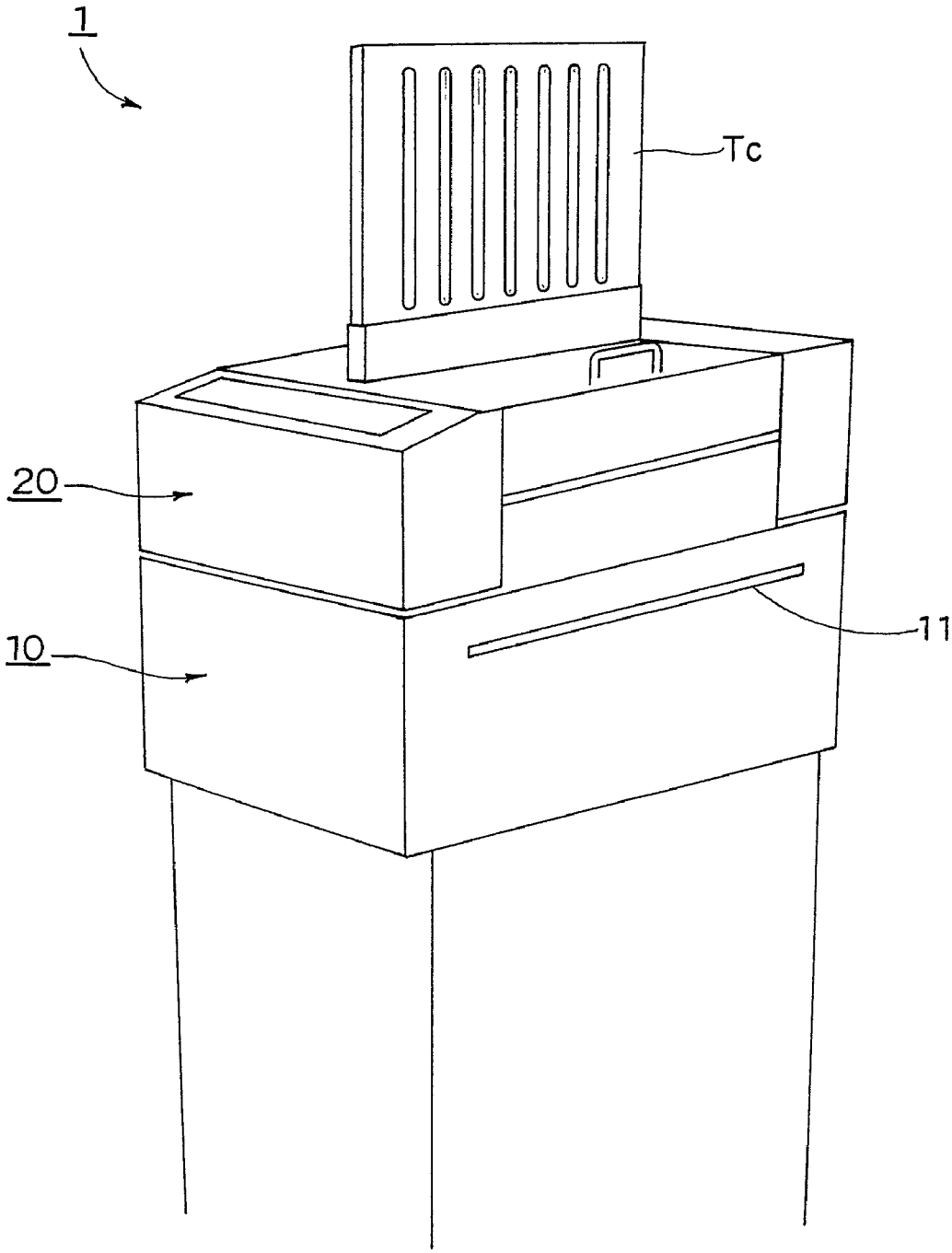
FIG. 1 is an external perspective view of a paper folding apparatus of the present invention.

FIG. 1 is an external perspective view of a paper folding apparatus of the present invention. This paper folding apparatus 1 includes a lower apparatus part 10 and an upper apparatus part 20. From the upper apparatus part 20, a portion of a conveyance path Tc is perpendicularly protruded.

Figure 2:
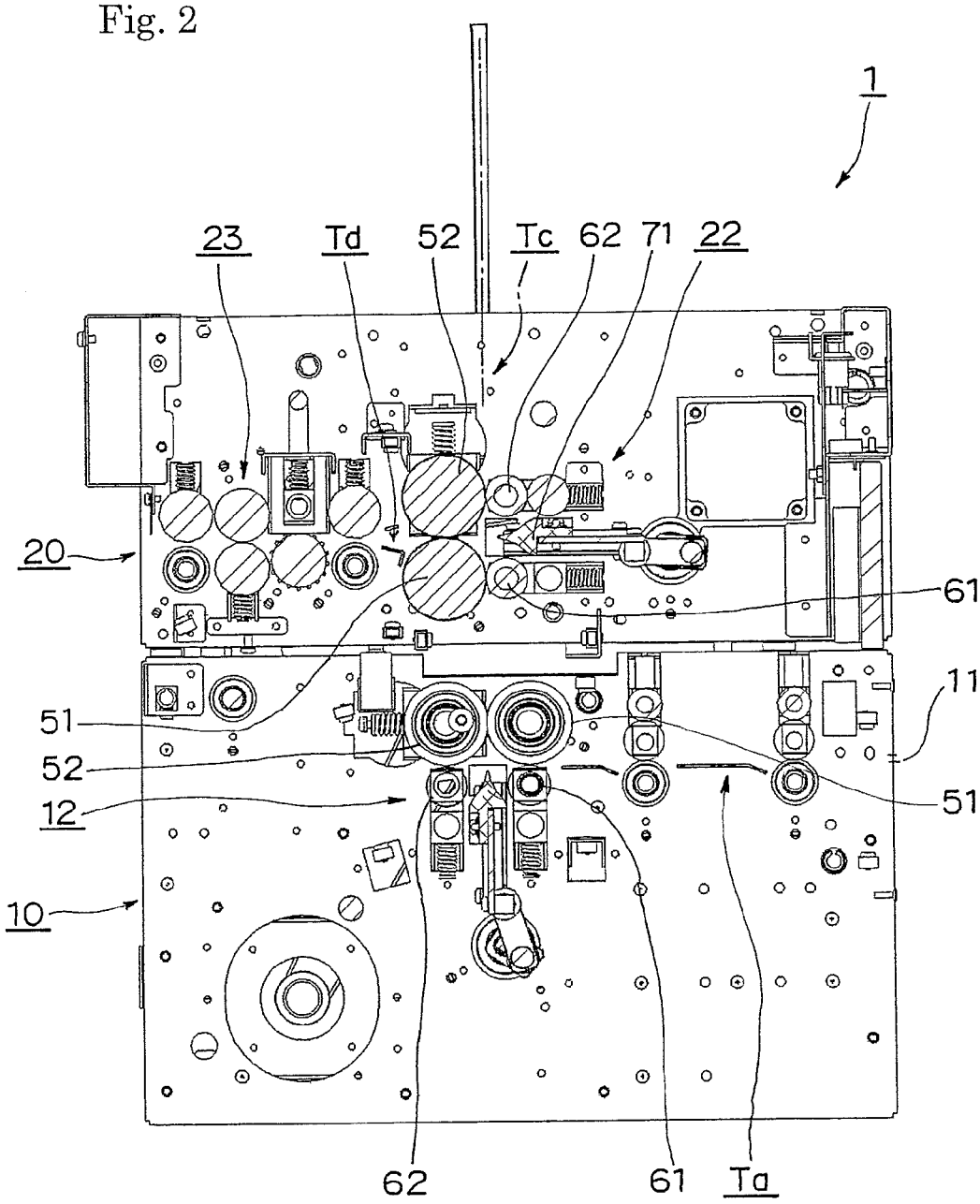
FIG. 2 is a central longitudinal cross-sectional view of FIG. 1.

FIG. 2 is a central longitudinal cross-sectional view of FIG. 1. The lower apparatus part 10 includes: a paper inlet 11; a horizontal conveyance path Ta; and a first paper folding mechanism 12. The upper apparatus part 20 includes: a second paper folding mechanism 22; the perpendicular conveyance path Tc; a horizontal conveyance path Td; and a de-curl mechanism 23.

Figure 3:
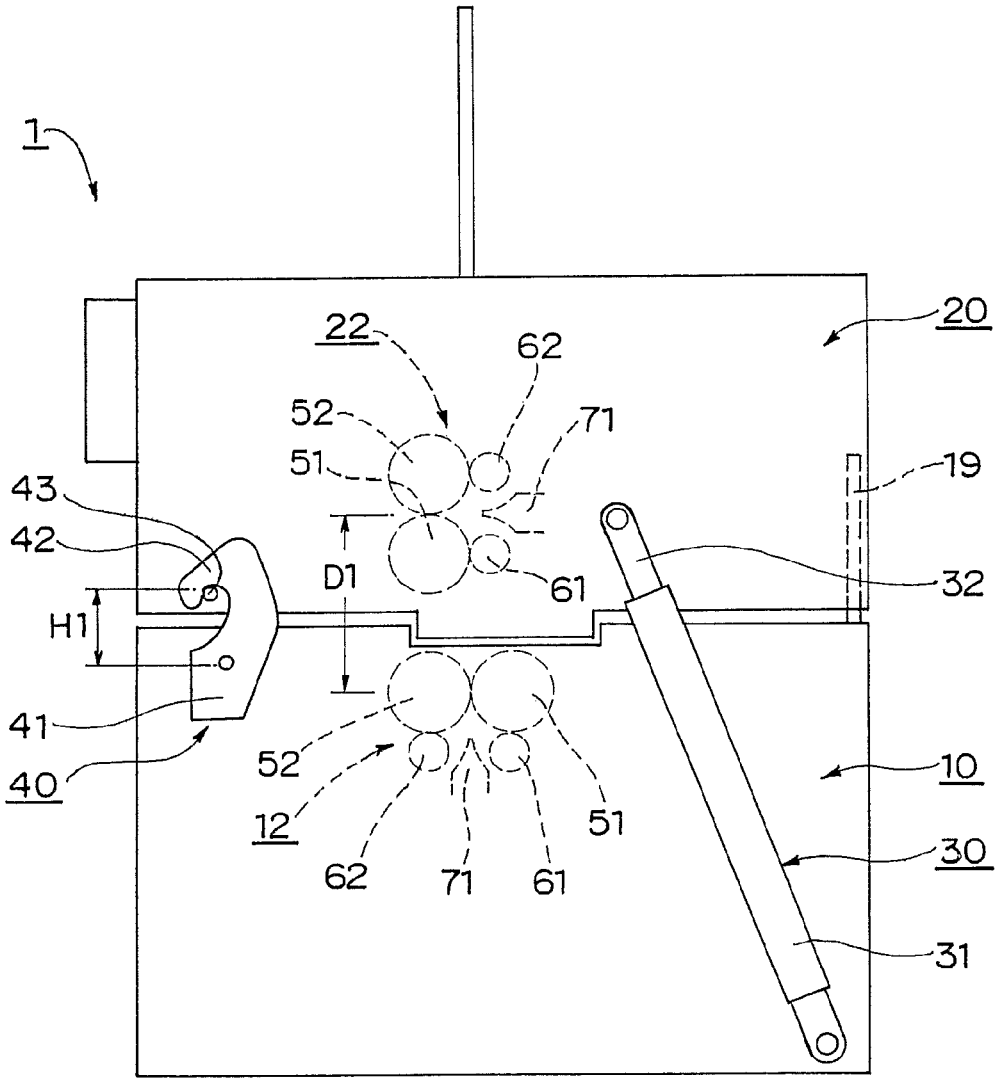
FIG. 3 is a side view illustrating a state in which an upper apparatus part is closed with respect to a lower apparatus part.
Figure 4:
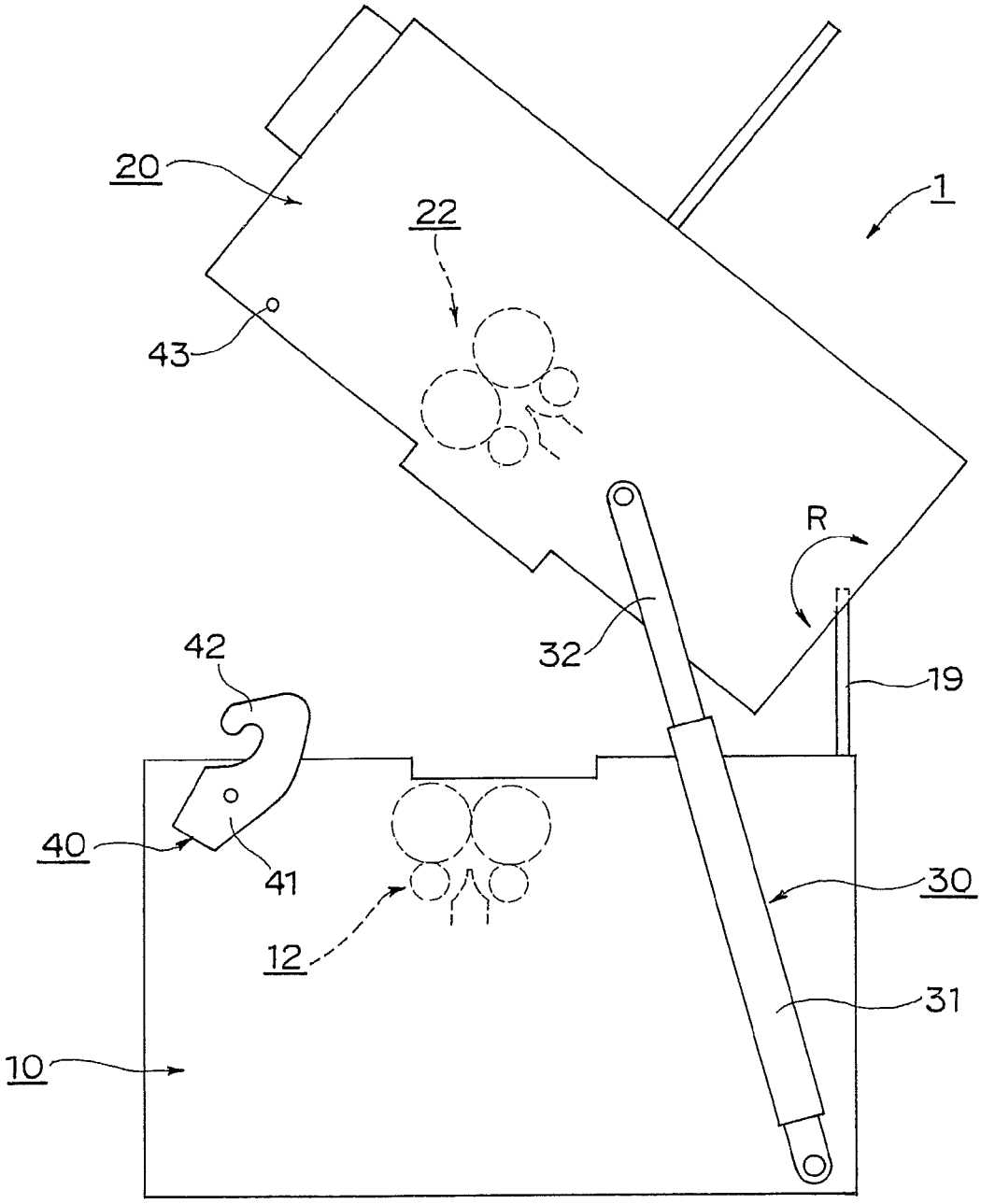
FIG. 4 is a side view illustrating a state in which the upper apparatus part is opened with respect to the lower apparatus part.

As illustrated in FIGS. 3 and 4, the upper apparatus part 20 is openable and closable with respect to the lower apparatus part 10. In the state of FIG. 3, i.e., in the state where the upper apparatus part 20 is closed with respect to the lower apparatus part 10, the second paper folding mechanism 22 is located immediately above the first paper folding mechanism 12, and a space D1 between the mechanisms 12 and 22 is maintained at a predetermined value. Furthermore, in the state of FIG. 4, i.e., in the state where the upper apparatus part 20 is opened with respect to the lower apparatus part 10, the mechanism 12 is exposed when viewed from above, and the mechanism 22 is exposed when viewed from below.

The upper apparatus part 20 is provided so as to be rotatable around a horizontal axis in the direction indicated by an arrow R with respect to an upper end of a vertical plate 19 of the lower apparatus part 10. The vertical plate 19 is provided at an upstream-side end of the lower apparatus part 10. The upper apparatus part 20 is constantly urged upward from the lower apparatus part 10 by a cylinder mechanism 30. In the cylinder mechanism 30, a lower end of a cylinder 31 is rotatably fixed to the lower apparatus part 10, and a tip of a rod 32 is rotatably fixed to the upper apparatus part 20. Moreover, one end 41 of a fastener 40 is rotatably fixed to the lower apparatus part 10, and a tip 42 of the fastener 40 can be hooked to a pin 43 of the upper apparatus part 20 from above.

Accordingly, the upper apparatus part 20 is closed with respect to the lower apparatus part 10 always at a height position H1 of the tip 42 of the fastener 40.

[Paper Folding Mechanism]

Figure 5:
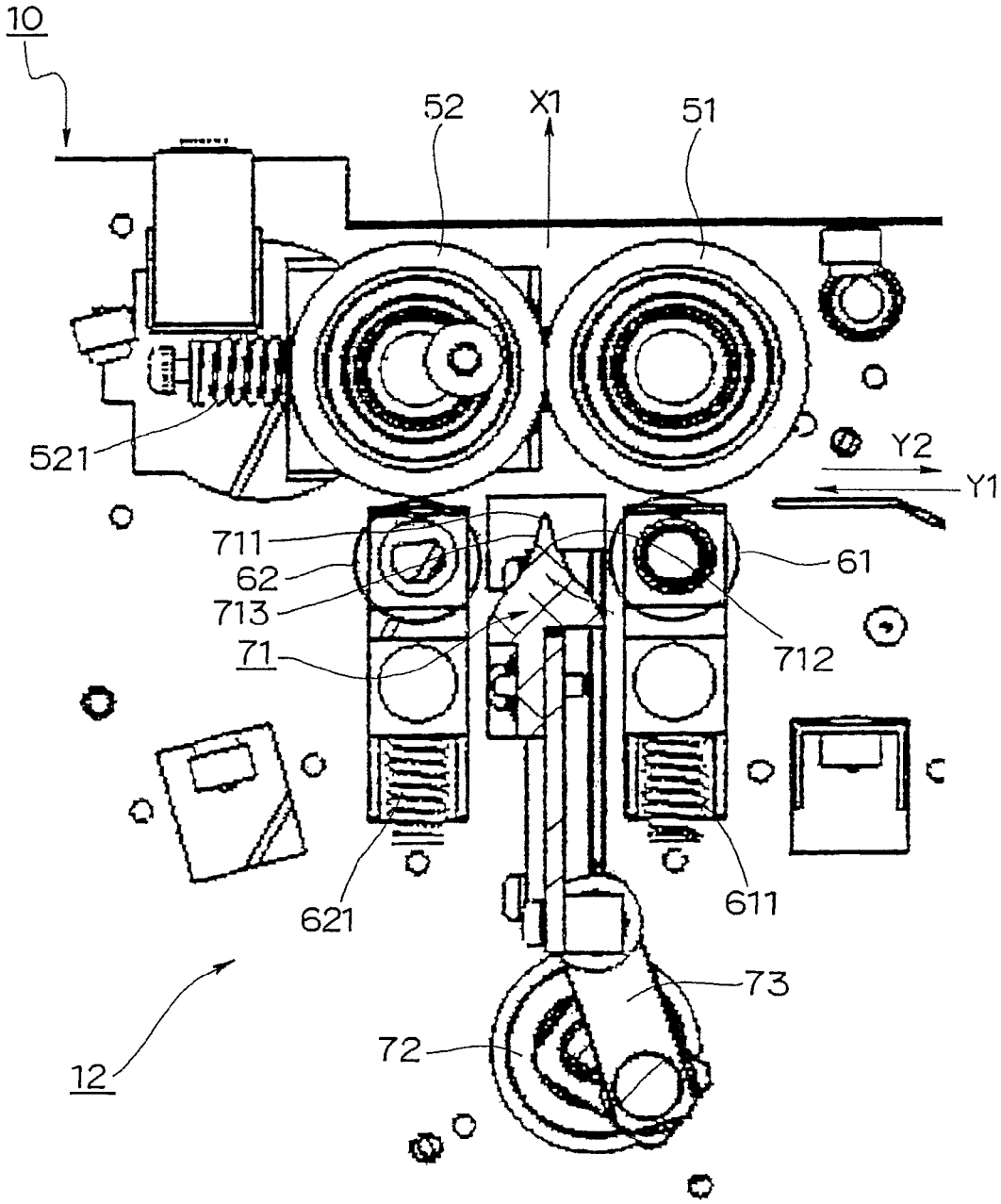
FIG. 5 is an enlarged view of a first paper folding mechanism illustrated in FIG. 2.

FIG. 5 is an enlarged view of the first paper folding mechanism 12 illustrated in FIG. 2. The first paper folding mechanism 12 includes: first and second folding rollers 51 and 52; first and second conveyance rollers 61 and 62; a protrusion member (which will also be called a "knife") 71; and a control part (not illustrated).

The first and second folding rollers 51 and 52 are arranged so that the rollers 51 and 52 are horizontally opposite to each other and a gap D2 is provided therebetween. More specifically, the first and second folding rollers 51 and 52 are provided so that a paper is sandwiched therebetween with its fold line located in front, and is allowed to pass therethrough in a first direction (i.e., in the direction indicated by an arrow X1). The first folding roller 51 is located at the upstream side of a conveyance direction (i.e., the direction indicated by an arrow Y1). The second folding roller 52 is urged toward the first folding roller 51 by a spring 521. It should be noted that although the gap D2 is not apparent in FIG. 5, the gap D2 is set at 0.1 to 0.2 mm. This is because a coated paper 110 gsm, which is the thinnest paper, has a thickness of 0.11 mm, and after being folded, the coated paper has a thickness of 0.22 mm; moreover, a folded portion of the coated paper has a thickness of about 0.3 mm.

The first conveyance roller 61 is pressed against the first folding roller 51 from below by a spring 611. More specifically, the first folding roller 51 and the first conveyance roller 61 are provided so that the paper is sandwiched therebetween and conveyed in a second direction (i.e., in the direction indicated by the arrow Y1) orthogonal to the first direction.

The second conveyance roller 62 is pressed against the second folding roller 52 from below by a spring 621. More specifically, the second folding roller 52 and the second conveyance roller 62 are provided so that the paper is sandwiched therebetween and conveyed in any one of the second direction and the direction opposite thereto (i.e., in the direction indicated by an arrow Y2).

The protrusion member 71 is located between the first and second conveyance rollers 61 and 62, and is provided so as to be movable forward/backward toward/from a position located between the first and second folding rollers 51 and 52. The protrusion member 71 is provided so as to be moved forward/backward by receiving a rotational drive force of a drive source 72 via a link 73, and so as to be located at the following three positions: a "standby position" at which the protrusion member 71 does not come into contact with the paper that has been conveyed by the first and second conveyance rollers 61 and 62; a "guide position" at which the paper to be conveyed is guided between the first and second folding rollers 51 and 52; and a "feeding position" at which the fold line of the paper conveyed by the first and second conveyance rollers 61 and 62 is protruded in the first direction, and fed between the first and second folding rollers 51 and 52.

Moreover, the protrusion member 71 includes: a pointed end 711 for allowing the fold line of the paper to enter between the first and second folding rollers 51 and 52; and curved surface portions 712 and 713 extended obliquely on both sides of the pointed end 711 in the direction opposite to the first direction.

At the time of a feeding operation, the control part moves the protrusion member 71 to the "feeding position" and rotates each of the rollers 51, 61, 52 and 62 so as to advance the fold line of the paper in the first direction. Furthermore, at the time of a folding operation, the control part moves the protrusion member 71 to the "guide position" and rotates each of the rollers 51, 61, 52 and 62 so as to advance the fold line of the paper in the first direction.

The second paper folding mechanism 22 also has a structure similar to that of the first paper folding mechanism 12. It is to be noted that in the second paper folding mechanism 22, the first and second folding rollers 51 and 52 are vertically opposed to each other, the first conveyance roller 61 is laterally pressed against the first folding roller 51 by the spring 611, and the second conveyance roller 62 is laterally pressed against the second folding roller 52 by the spring 621.

[Operations]

Next, operations for folding processes in the present apparatus 1 will be described with reference to FIGS. 6 to 13.

Figure 6:
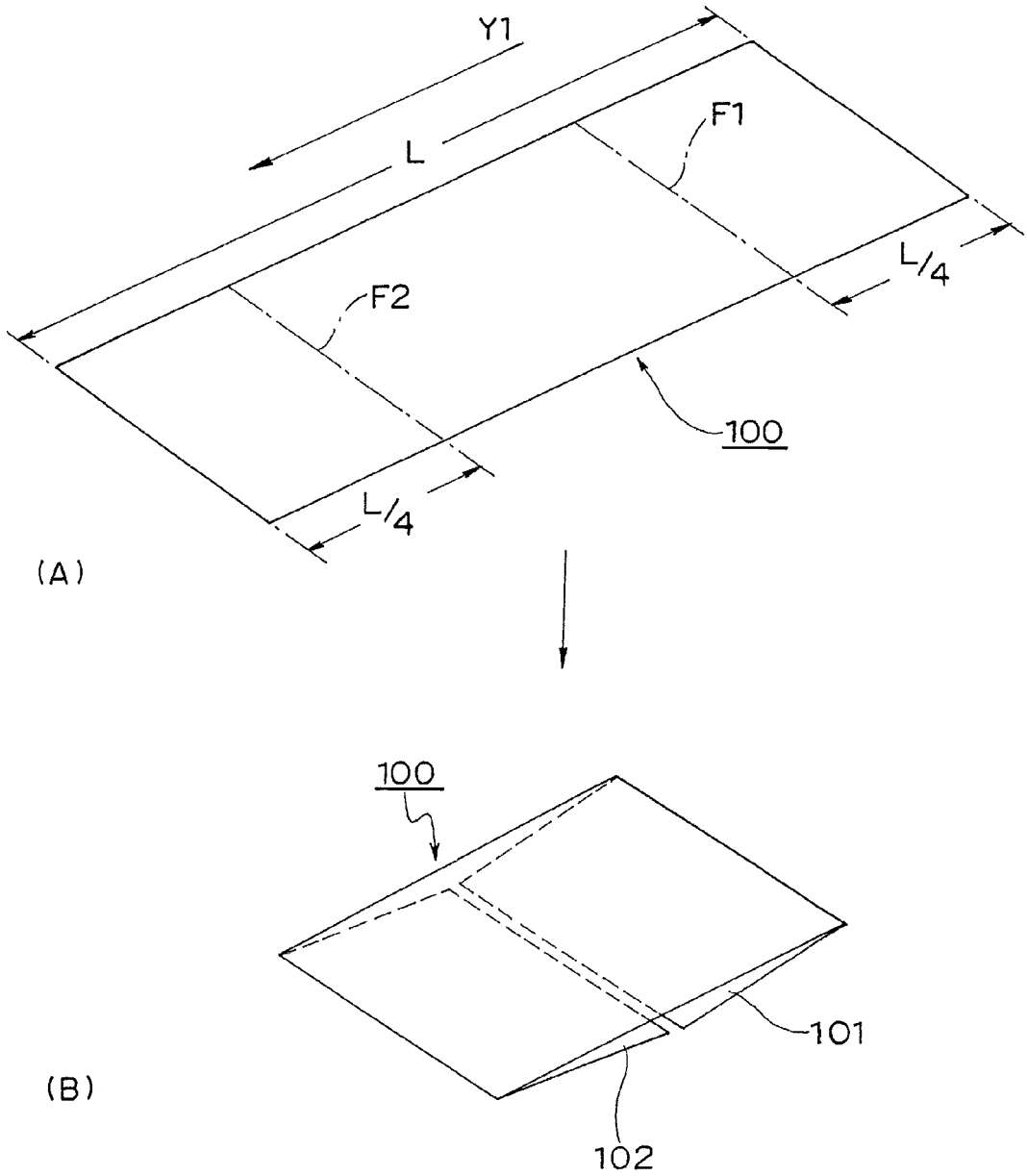
FIG. 6 is a perspective view for describing the form of "gate-folding".

Hereinafter, the description will be made about a case where "gate-folding" is performed. As illustrated in FIG. 6, "gate-folding" means that a paper 100 illustrated in (A) is folded to one side along two fold lines F1 and F2, and is changed into the state illustrated in (B). When the length of the paper 100 along the conveyance direction is defined as L, the first fold line F1 is formed at a position corresponding to L/4 at the upstream side of the conveyance direction, while the second fold line F2 is formed at a position corresponding to L/4 at the downstream side of the conveyance direction. The "gate-folded" paper 100 has two inwardly opening folded pieces 101 and 102.

First, the paper 100 inserted into the inlet 11 is conveyed through the conveyance path Ta to the first paper folding mechanism 12. It should be noted that at this point, the protrusion member 71 of the mechanism 12 is placed at the "standby position".

(Operations of First Paper Folding Mechanism 12)

(1) Conveyance Operation

Figure 7:
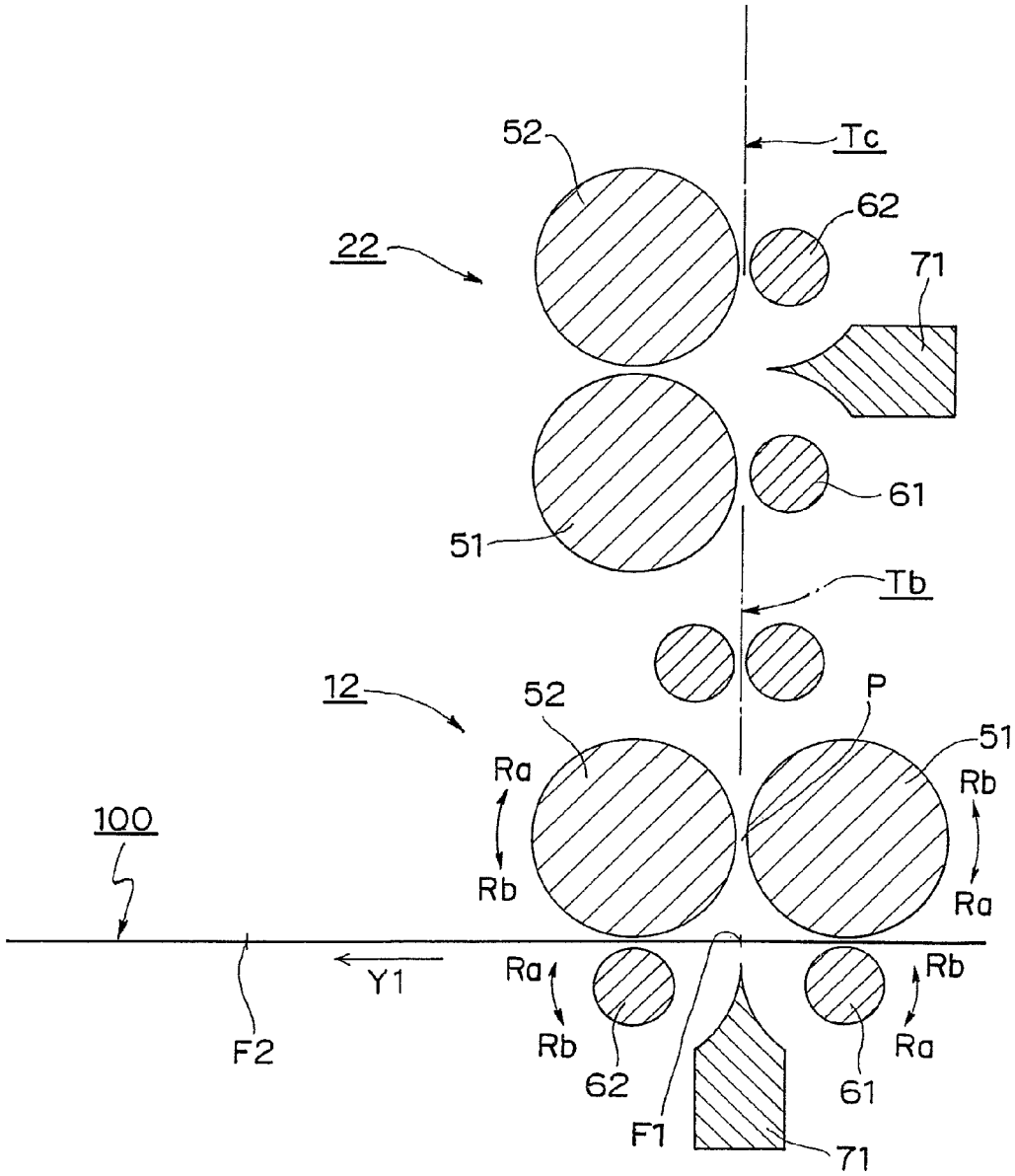
FIG. 7 is a longitudinal cross-sectional view illustrating a conveyance operation of the first paper folding mechanism.

As illustrated in FIG. 7, the paper 100, which has been conveyed to the mechanism 12, is sandwiched between the first folding roller 51 and the first conveyance roller 61, and is then sandwiched between the second folding roller 52 and the second conveyance roller 62, so that the paper 100 is conveyed in the direction indicated by the arrow Y1. During this time, the first folding roller 51 is rotated in an Ra direction, the first conveyance roller 61 is rotated in an Rb direction, the second folding roller 52 is rotated in the Ra direction, and the second conveyance roller 62 is rotated in the Rb direction. Then, upon arrival of the first fold line F1 of the paper 100 at the position of the protrusion member 71, the rotations of the rollers 51, 61, 52 and 62 are each stopped.

(2) Feeding Operation

Figure 8:
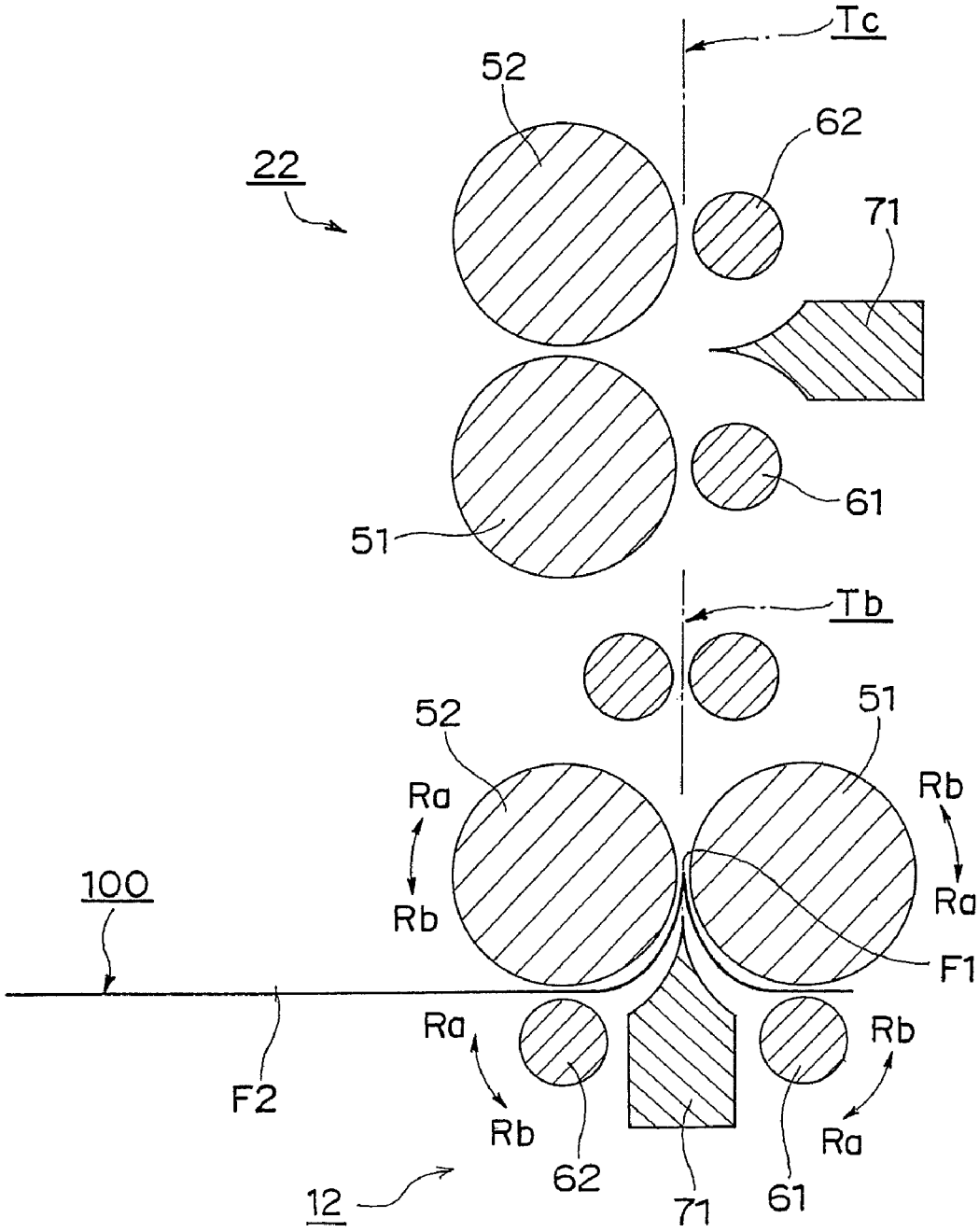
FIG. 8 is a longitudinal cross-sectional view illustrating a feeding operation of the first paper folding mechanism.

Next, as illustrated in FIG. 8, the protrusion member 71 is moved to the "feeding position" together with the first fold line F1. Furthermore, at this point, the first folding roller 51 is rotated in the Ra direction, the first conveyance roller 61 is rotated in the Rb direction, the second folding roller 52 is rotated in the Rb direction, and the second conveyance roller 62 is rotated in the Ra direction. In other words, the rollers 51, 61, 52 and 62 are each rotated so that the first fold line F1 advances in the direction indicated by the arrow X1. Thus, the paper 100 is sandwiched between the first and second folding rollers 51 and 52 with the first fold line F1 located in front.

(3) Folding Operation

Figure 9:
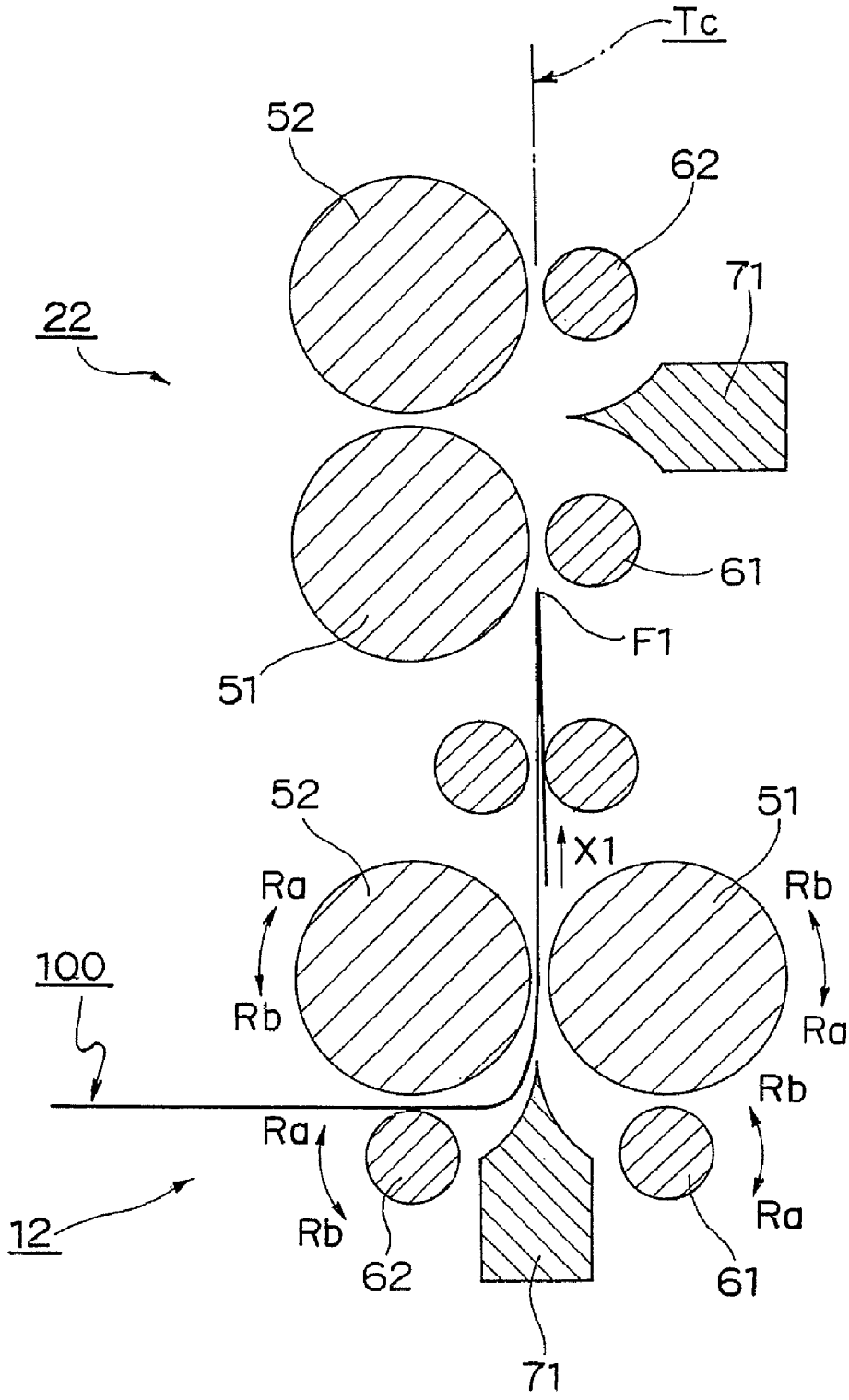
FIG. 9 is a longitudinal cross-sectional view illustrating a folding operation of the first paper folding mechanism.

Next, as illustrated in FIG. 9, the paper 100 is sandwiched between the first and second folding rollers 51 and 52 with the first fold line F1 located in front, and is conveyed in the direction indicated by the arrow X1. At this point, the protrusion member 71 has been returned to the "standby position". Further, the rollers 51, 61, 52 and 62 are each rotated so that the first fold line F1 advances in the direction indicated by the arrow X1.

Then, the paper 100 is conveyed through a conveyance path Tb to the second paper folding mechanism 22. It should be noted that at this point, the protrusion member 71 of the mechanism 22 is placed at the "standby position".

It should also be noted that when both of the rollers 51 and 52 each have a diameter of 40 mm, the distance from a nip position P of both of the rollers 51 and 52 to the pointed end 711 of the protrusion member 71 is set at 4 mm when the protrusion member 71 is located at the "feeding position", set at 6 mm when the protrusion member 71 is located at the "guide position", and set at 24 mm when the protrusion member 71 is located at the "standby position".

(Operations of Second Paper Folding Mechanism 22)

(1) Conveyance Operation

Figure 10:
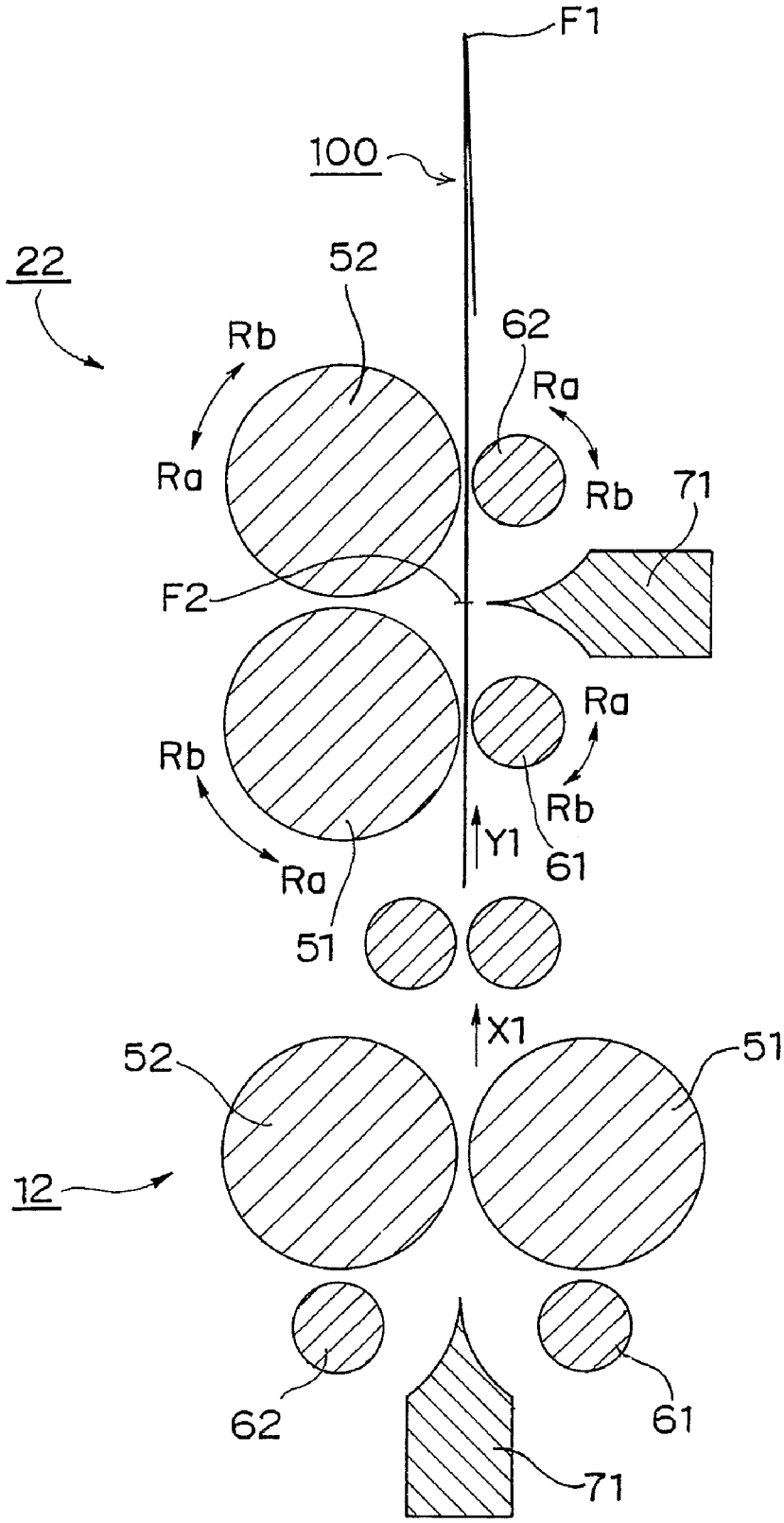
FIG. 10 is a longitudinal cross-sectional view illustrating a conveyance operation of a second paper folding mechanism.

As illustrated in FIG. 10, the paper 100, which has been conveyed to the mechanism 22, is sandwiched between the first folding roller 51 and the first conveyance roller 61 with the first fold line F1 located in front, and is then sandwiched between the second folding roller 52 and the second conveyance roller 62, so that the paper 100 is conveyed in the direction indicated by the arrow Y1. During this time, the rotational directions of the rollers 51, 61, 52 and 62 are similar to those of the rollers of the first paper folding mechanism 12. It should be noted that the direction indicated by the arrow Y1 in the second paper folding mechanism 22 is the direction extended from the direction indicated by the arrow X1 in the first paper folding mechanism 12. Then, upon arrival of the second fold line F2 of the paper 100 at the position of the protrusion member 71, the rotations of the rollers 51, 61, 52 and 62 are each stopped.

(2) Feeding Operation

Figure 11:
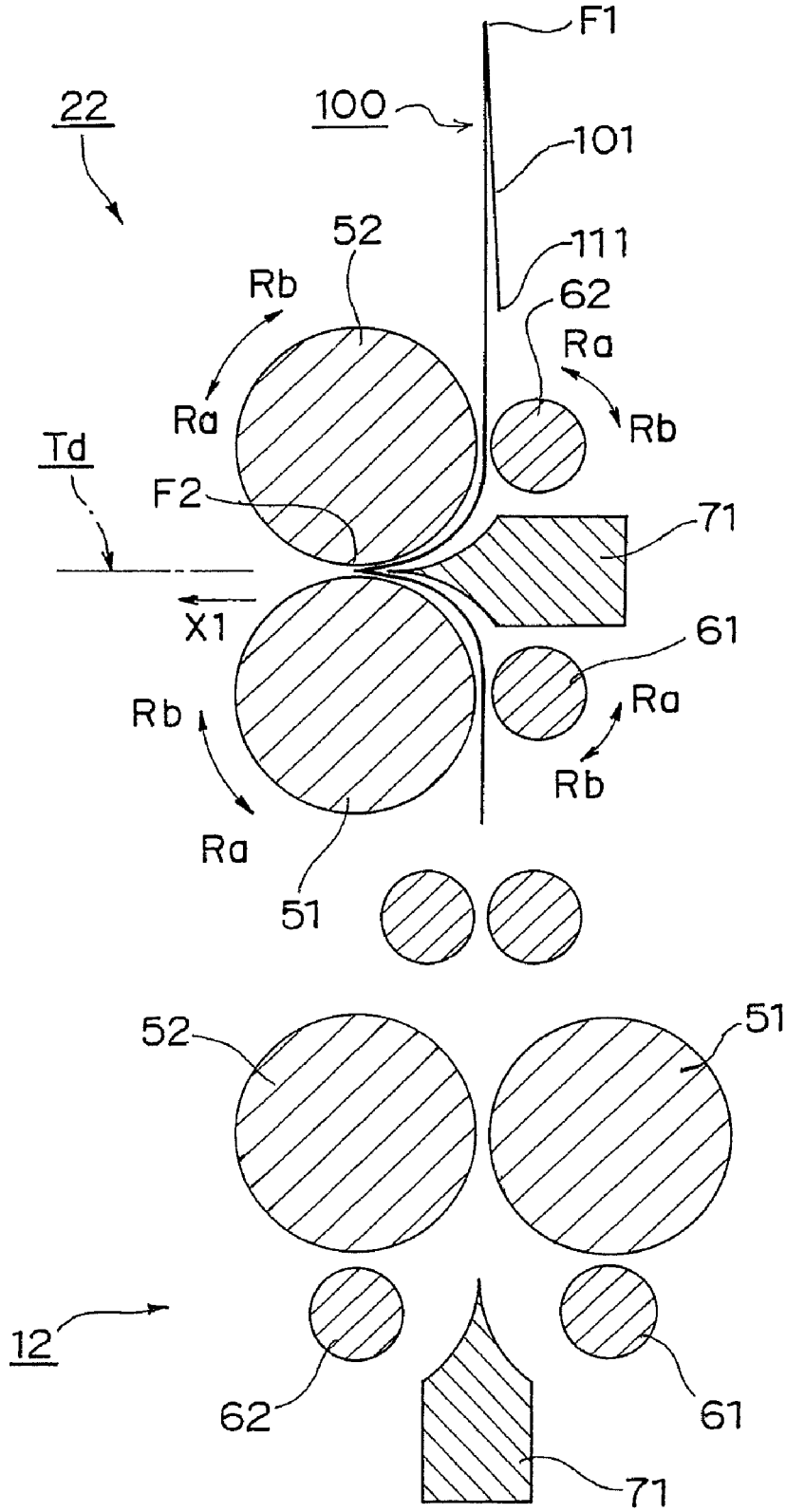
FIG. 11 is a longitudinal cross-sectional view illustrating a feeding operation of the second paper folding mechanism.

Next, as illustrated in FIG. 11, the protrusion member 71 is moved to the "feeding position" together with the second fold line F2. Furthermore, at this point, the first folding roller 51 is rotated in the Ra direction, the first conveyance roller 61 is rotated in the Rb direction, the second folding roller 52 is rotated in the Rb direction, and the second conveyance roller 62 is rotated in the Ra direction. In other words, the rollers 51, 61, 52 and 62 are each rotated so that the second fold line F2 advances in the direction indicated by the arrow X1. Thus, the paper 100 is sandwiched between the first and second folding rollers 51 and 52 with the second fold line F2 located in front.

(3) Folding Operation

Figure 12:
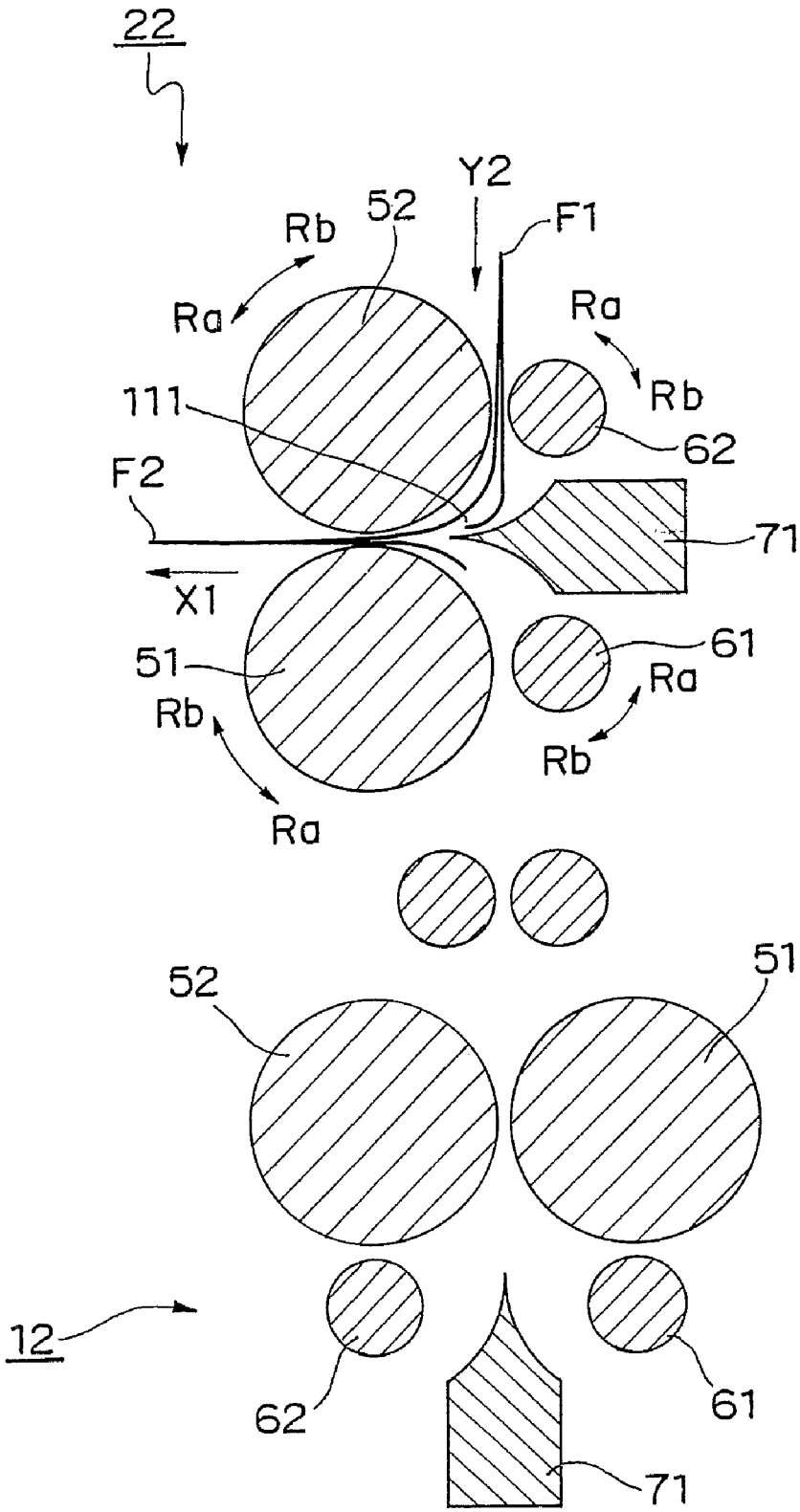
FIG. 12 is a longitudinal cross-sectional view illustrating a folding operation of the second paper folding mechanism.

Next, as illustrated in FIG. 12, the paper 100 is conveyed by the first and second folding rollers 51 and 52 in the direction indicated by the arrow X1, with the second fold line F2 located in front. At this point, the protrusion member 71 has been returned to the "guide position". Hence, an inner edge 111 of the folded piece 101 of the paper 100 is smoothly conveyed in the direction indicated by the arrow X1 along the curved surface portion 712 of the protrusion member 71. Further, the rotational directions of the rollers 51, 61, 52 and 62 are similar to those of the rollers of the first paper folding mechanism 12.

Then, the paper 100 is conveyed to the de-curl mechanism 23.

(Operational Outlines)

Figure 13:
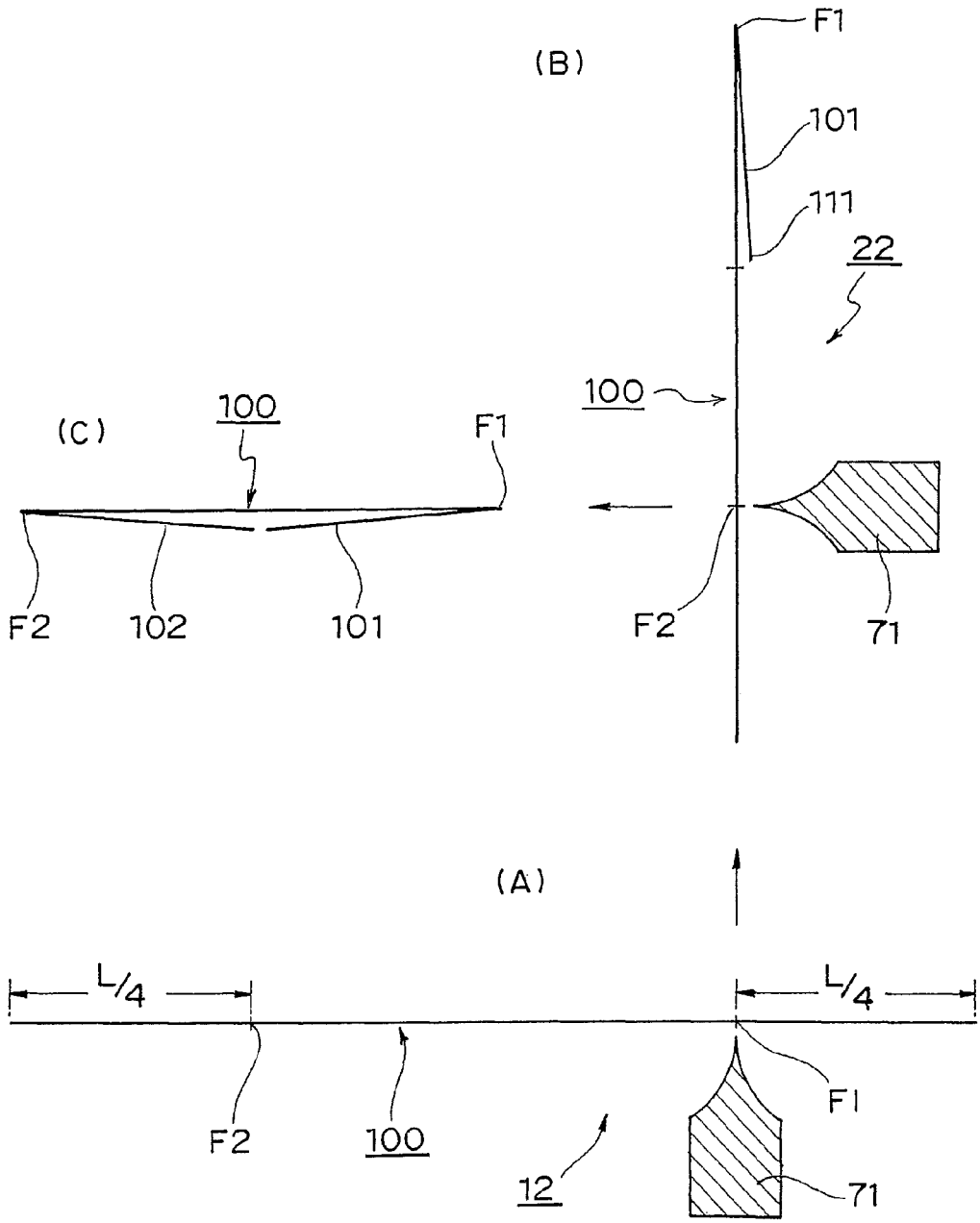
FIG. 13 is a schematic diagram illustrating the operational outlines associated with FIGS. 7 to 12.

FIG. 13 schematically illustrates the above-described operations. Specifically, the protrusion member 71 acts on the first fold line F1 in the first paper folding mechanism 12 as illustrated in (A), the protrusion member 71 acts on the second fold line F2 in the second paper folding mechanism 22 as illustrated in (B), and as a result, the "gate-folded" paper 100 is obtained as illustrated in (C).

[Effects]

The first paper folding mechanism 12 with the above-described structure is capable of achieving the following effects.

(1) In the conveyance operation, the paper 100 is sandwiched between the first folding roller 51 and the first conveyance roller 61, and is then sandwiched between the second folding roller 52 and the second conveyance roller 62, so that the paper 100 is conveyed thereby; therefore, the paper 100 can be conveyed to the accurate position. Accordingly, the first fold line F1 can be accurately set at the position of the protrusion member 71.

(2) In the feeding operation, the protrusion member 71 is moved to the "feeding position" together with the first fold line F1, and the rollers 51, 61, 52 and 62 are each rotated so that the first fold line F1 advances in the direction indicated by the arrow X1. Therefore, the first fold line F1 of the paper 100 can be fed between the first and second folding rollers 51 and 52 accurately and smoothly. Accordingly, the paper 100 can be accurately folded along the first fold line F1.

(3) In the folding operation, the rollers 51, 61, 52 and 62 are each rotated so that the first fold line F1 advances in the direction indicated by the arrow X1. Therefore, the occurrence of slippage between the paper 100 and the respective rollers 51, 61, 52 and 62 can be prevented, and it is possible to facilitate the passage of the paper 100 between the first and second folding rollers 51 and 52, with the first fold line F1 located in front. Accordingly, it is possible to smoothly perform the folding process without damaging the paper 100.

Besides, the second paper folding mechanism 22 with the above-described structure is capable of achieving the following effects.

(1) In the conveyance operation, the paper 100 is sandwiched between the first folding roller 51 and the first conveyance roller 61, and is then sandwiched between the second folding roller 52 and the second conveyance roller 62, so that the paper 100 is conveyed thereby; therefore, the paper 100 can be conveyed to the accurate position. Accordingly, the second fold line F2 can be accurately set at the position of the protrusion member 71.

(2) In the feeding operation, the protrusion member 71 is moved to the "feeding position" together with the second fold line F2, and the rollers 51, 61, 52 and 62 are each rotated so that the second fold line F2 advances in the direction indicated by the arrow X1. Therefore, the second fold line F2 of the paper 100 can be fed between the first and second folding rollers 51 and 52 accurately and smoothly. Accordingly, the paper 100 can be accurately folded along the second fold line F2.

(3) In the folding operation, the rollers 51, 61, 52 and 62 are each rotated so that the second fold line F2 advances in the direction indicated by the arrow X1. Therefore, the occurrence of slippage between the paper 100 and the respective rollers 51, 61, 52 and 62 can be prevented, and it is possible to facilitate the passage of the paper 100 between the first and second folding rollers 51 and 52, with the second fold line F2 located in front. Accordingly, it is possible to smoothly perform the folding process without damaging the paper 100.

(4) In the folding operation, since the protrusion member 71 is located at the "guide position", the inner edge 111 of the folded piece 101 of the paper 100 can be smoothly conveyed in the direction indicated by the arrow X1 along the curved surface portion 712 of the protrusion member 71. Accordingly, also in this respect, the folding process can be smoothly performed.

In addition, the paper folding apparatus 1 with the above-described structure is capable of achieving the following effects.

(1) Since the paper folding apparatus 1 includes the two paper folding mechanisms 12 and 22, the folding processes can be accurately performed on the first and second fold lines F1 and F2.

(2) Since the protrusion member 71 has the curved surface portions 712 and 713, the folded piece, which has been formed first, can be smoothly conveyed by allowing the folded piece to move along the curved surface portion when the subsequent folding process is performed.

(3) When a jam has occurred in either of the two paper folding mechanisms 12 and 22, the jam can be easily cleared because both the mechanisms 12 and 22 can be exposed by opening the upper apparatus part 20 with respect to the lower apparatus part 10.

(4) Although the upper apparatus part 20 is openable and closable with respect to the lower apparatus part 10, the upper apparatus part 20 is constantly urged upward from the lower apparatus part 10 by the cylinder mechanism 30, and therefore, the upper apparatus part 20 is closed with respect to the lower apparatus part 10 always at the height position of the tip 42 of the fastener 40. Accordingly, the height position of the second paper folding mechanism 22 with respect to the first paper folding mechanism 12 can be maintained at the constant value D1 with accuracy at all times. Hence, the folding process can be accurately performed on the second fold line F2 in the second paper folding mechanism 22.

It should be noted that the paper folding apparatus 1 with the above-described structure is capable of performing folding processes in the following folding forms.

Figure 14:
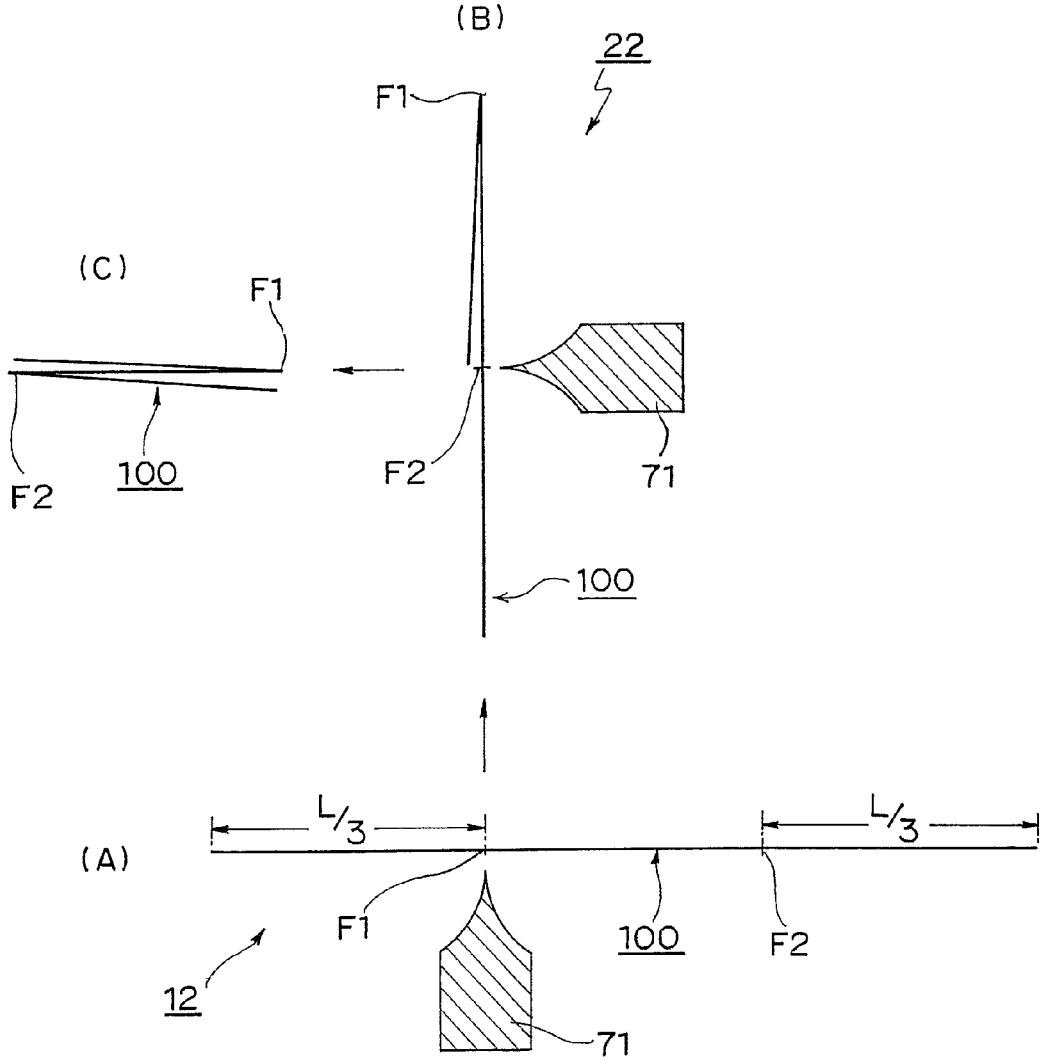
FIG. 14 is a diagram corresponding to FIG. 13, and illustrating the operational outlines of a folding process performed in the form of "Z-folding".

(1) FIG. 14 illustrates a folding process performed in the form of "Z-folding". In this case, the first fold line F1 is set at a position corresponding to L/3 at the downstream side of the conveyance direction, and the second fold line F2 is set at a position corresponding to L/3 at the upstream side of the conveyance direction.

Figure 15:
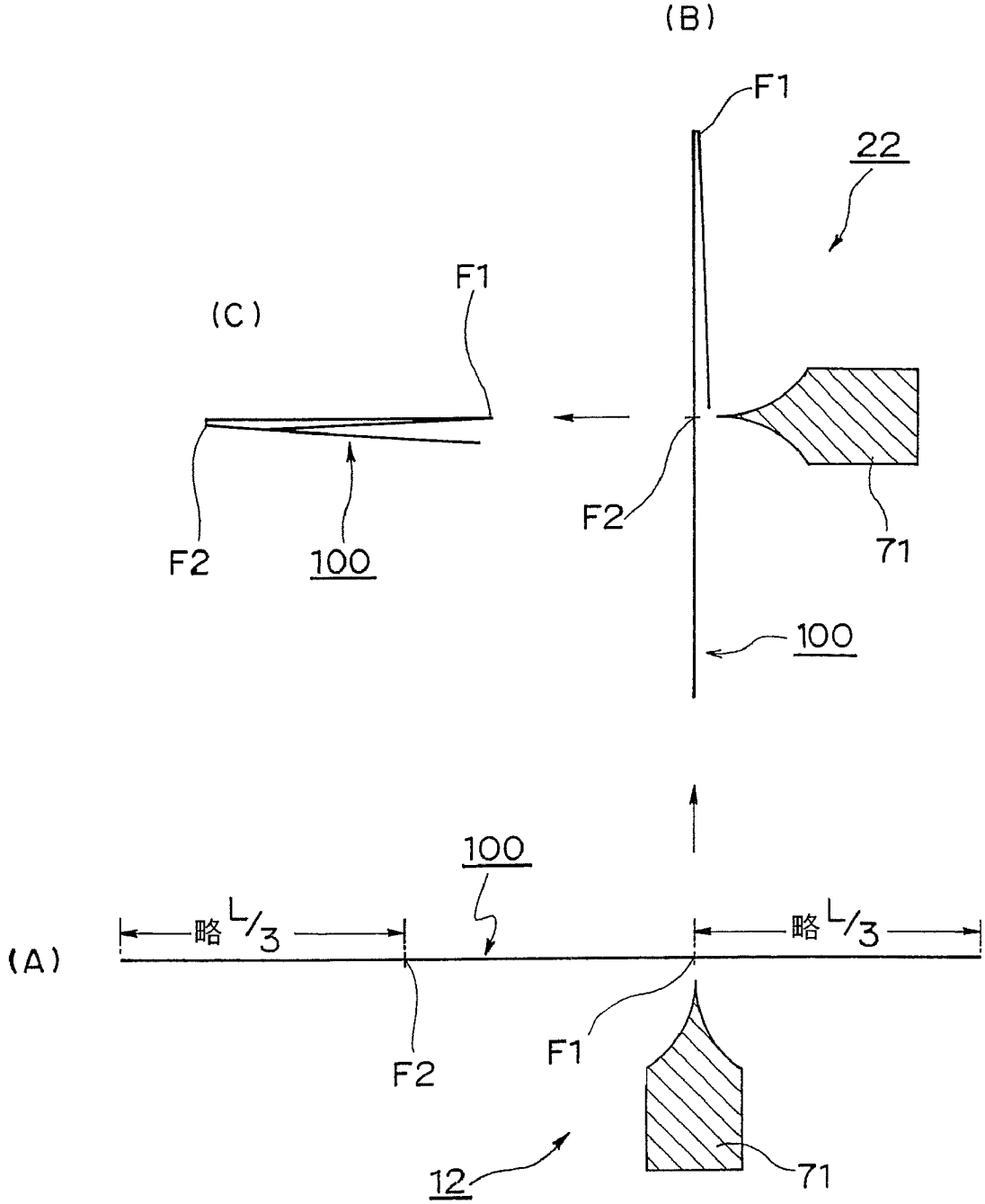
FIG. 15 is a diagram corresponding to FIG. 13, and illustrating the operational outlines of a folding process performed in the form of "C-folding".

(2) FIG. 15 illustrates a folding process performed in the form of "C-folding". In this case, the first fold line F1 is set at a position corresponding to about L/3 at the upstream side of the conveyance direction, and the second fold line F2 is set at a position corresponding to about L/3 at the downstream side of the conveyance direction.

Figure 16:
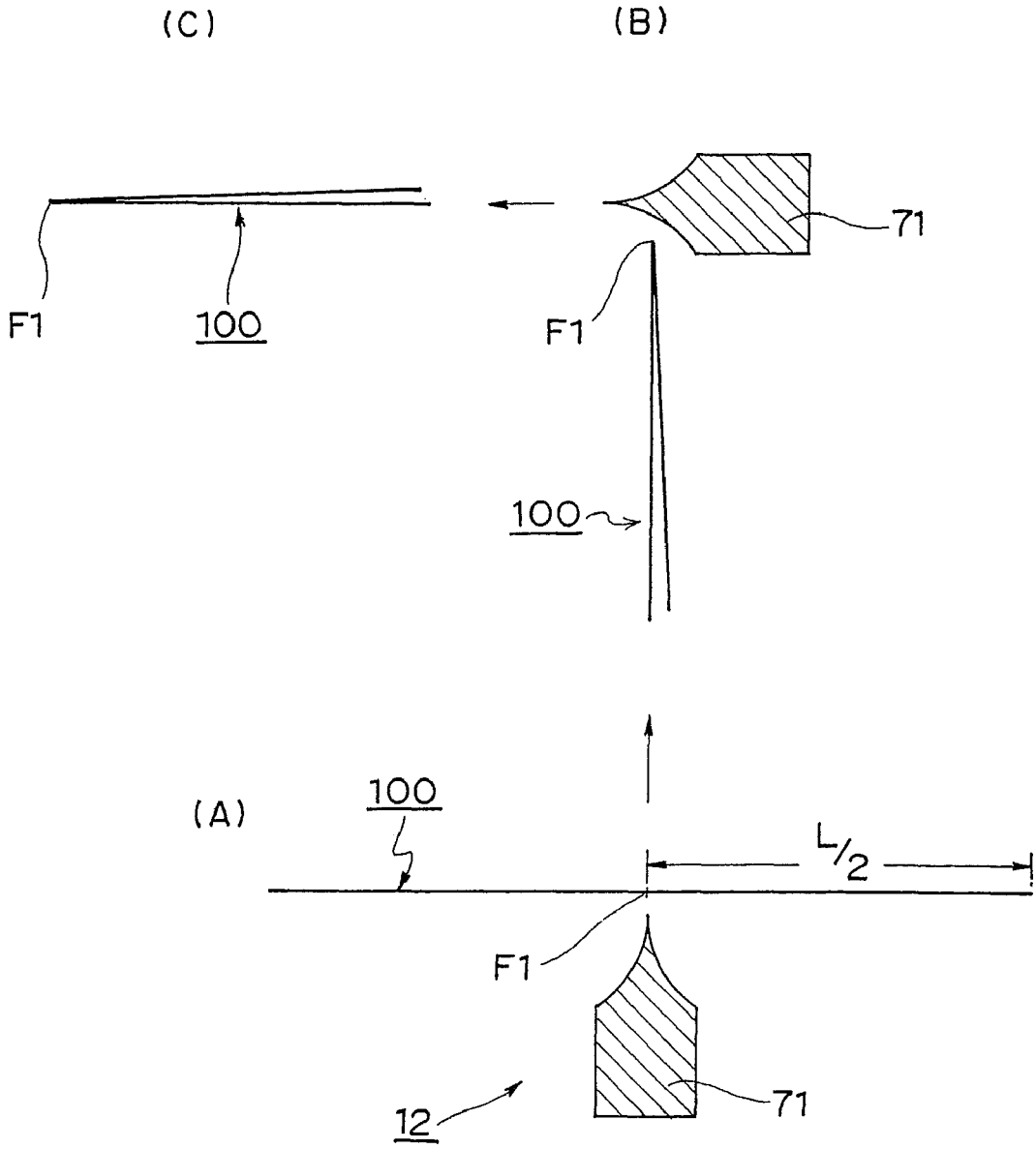
FIG. 16 is a diagram corresponding to FIG. 13, and illustrating the operational outlines of a folding process performed in the form of "V-folding".

(3) FIG. 16 illustrates a folding process performed in the form of "V-folding". In this case, the first fold line F1 is set at a position corresponding to L/2 of the conveyance direction, and no second fold line F2 is set. Accordingly, in this case, the protrusion member 71 is set at the "guide position" during the operation of the second paper folding mechanism 22.

Figure 17:
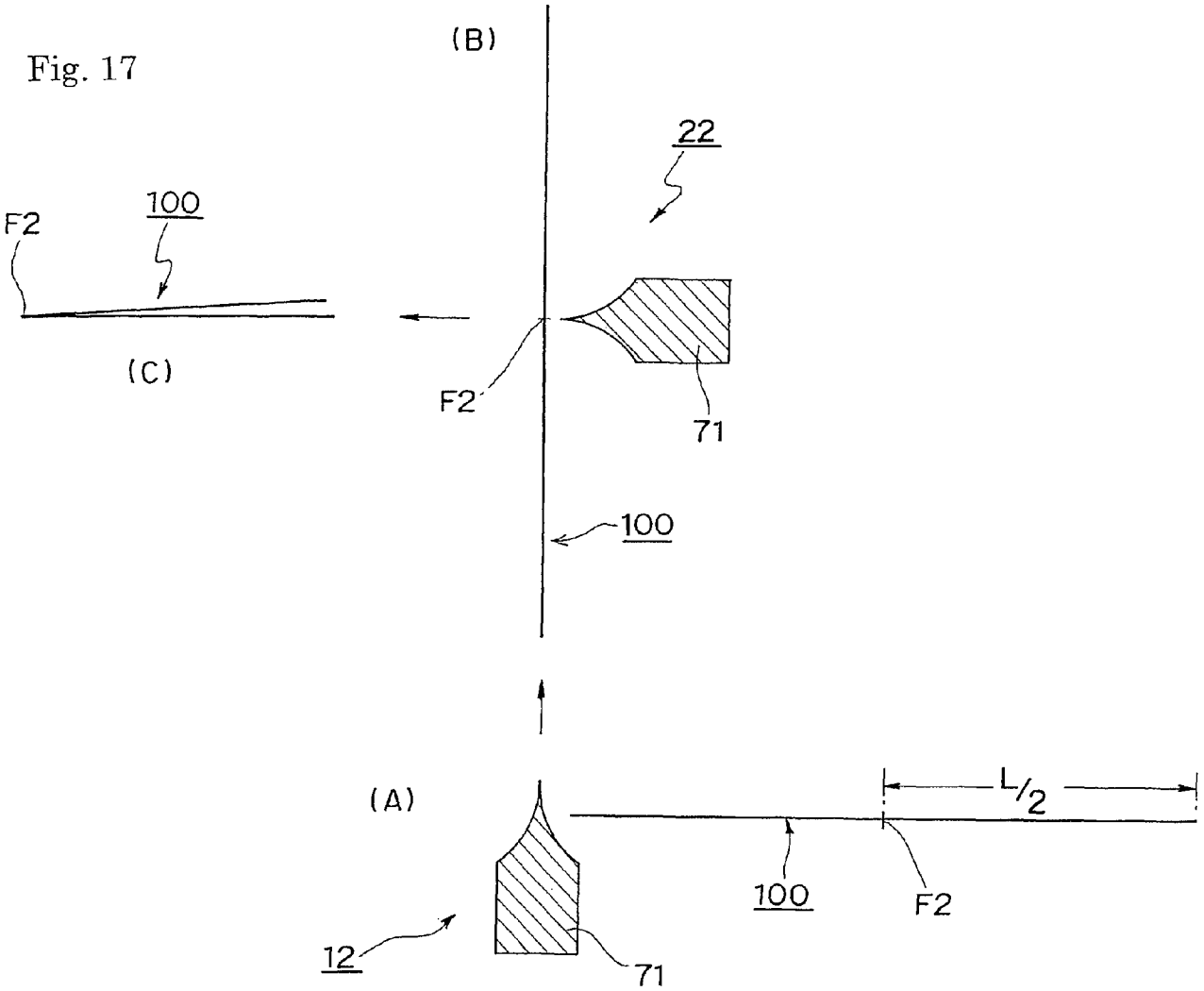
FIG. 17 is a diagram corresponding to FIG. 13, and illustrating the operational outlines of a folding process performed in the form of "V-folding".

(4) FIG. 17 also illustrates a folding process performed in the form of "V-folding". In this case, no first fold line F1 is set, but the second fold line F2 is set at a position corresponding to L/2 of the conveyance direction. Accordingly, in this case, the protrusion member 71 is set at the "guide position" during the operation of the first paper folding mechanism 12.

Moreover, in the paper folding apparatus 1 with the above-described structure, the position of the protrusion member 71 may be the "standby position" at the time of the folding operation of the first paper folding mechanism 12 except for the "V-folding" process illustrated in FIG. 17, and furthermore, the position of the protrusion member 71 may be the "standby position" at the time of the folding operation of the second paper folding mechanism 22 except for the "C-folding" process illustrated in FIG. 15, the "V-folding" process illustrated in FIG. 17, and the "gate-folding" illustrated in FIG. 6.

INDUSTRIAL APPLICABILITY

The paper folding mechanisms of the present invention is capable of accurately folding a paper along its fold line without damaging the paper, and is thus industrially valuable.

What is claimed is:

1. A paper folding apparatus comprising at least two paper folding mechanisms for performing a folding process on a paper along its fold line while conveying the paper which are arranged one above the other so that the folding process can be continuously performed on the paper, wherein each paper folding mechanism comprises: first and second folding rollers; first and second conveyance rollers; a protrusion member; and a control part, wherein the first and second folding rollers are provided so that the paper is sandwiched therebetween with its fold line located in front, and is allowed to pass therethrough in a first direction, wherein the first folding roller and the first conveyance roller are provided so that the paper is sandwiched therebetween and conveyed in a second direction orthogonal to the first direction, wherein the second folding roller and the second conveyance roller are provided so that the paper is sandwiched therebetween and conveyed in any one of the second direction and the direction opposite thereto, wherein the protrusion member is provided so that the fold line of the paper, which has been conveyed by the first and second conveyance rollers, is protruded in the first direction and fed between the first and second folding rollers, the protrusion member being provided so as to be movable among: a standby position at which the protrusion member does not come into contact with the paper that has been conveyed; a feeding position at which the fold line of the paper that has been conveyed is protruded and fed between the first and second folding rollers; and a guide position at which the paper to be conveyed is guided between the first and second folding rollers, and wherein at the time of a feeding operation, the control part moves the protrusion member to the feeding position and rotates each of the rollers so as to advance the fold line of the paper in the first direction, and at the time of a folding operation, the control part moves the protrusion member to the guide position and rotates each of the rollers so as to advance the fold line of the paper in the first direction, wherein an upper apparatus part comprising the upper paper folding mechanism is provided so as to be openable and closable with respect to a lower apparatus part comprising the lower paper folding mechanism, wherein the paper folding mechanism of the lower apparatus part is provided so as to be exposed upon opening of the upper apparatus part with respect to the lower apparatus part.

2. The paper folding mechanism according to claim 1, wherein the protrusion member comprises: a pointed end for allowing the fold line of the paper to enter between the first and second folding rollers; and curved surface portions extended obliquely on both sides of the pointed end in the direction opposite to the first direction.

3. A paper folding apparatus according to claim 1, wherein the upper apparatus part is constantly urged upward from the lower apparatus part, and wherein the upper apparatus part is closed with respect to the lower apparatus part by hooking the upper apparatus part to a fastener extended from the lower apparatus part.

* * * * *